US008189967B1

(12) United States Patent
Olson

(10) Patent No.: US 8,189,967 B1
(45) **Date of Patent: *May 29, 2012**

(54) FIBER OPTIC SIGHT FOR FIREARMS

(75) Inventor: Douglas D. Olson, Huntsville, AR (US)

(73) Assignee: Wilsons Gun Shop Inc, Berryville, AR (US)

( * ) Notice: Subject to any disclaimer, the term of this patent is extended or adjusted under 35 U.S.C. 154(b) by 1296 days.

This patent is subject to a terminal disclaimer.

(21) Appl. No.: 11/899,069

(22) Filed: Sep. 5, 2007

(51) Int. Cl.
*G02B 6/00* (2006.01)

(52) U.S. Cl. ..... 385/12; 42/132

(58) Field of Classification Search ..... 385/12; 33/265; 42/132
See application file for complete search history.

(56) References Cited

U.S. PATENT DOCUMENTS

| | | | | | |
|---|---|---|---|---|---|
| 3,645,635 | A * | 2/1972 | Steck | 356/252 |
| 4,494,327 | A * | 1/1985 | Cullity | 42/132 |
| 5,582,170 | A * | 12/1996 | Soller | 600/322 |
| 5,638,604 | A | 6/1997 | Lorocco | |
| 5,835,649 | A * | 11/1998 | Turner et al. | 385/31 |
| 5,836,100 | A | 11/1998 | Stover | |
| 5,924,234 | A * | 7/1999 | Bindon et al. | 42/123 |
| 5,956,854 | A | 9/1999 | Lorocco | |
| 6,085,427 | A | 7/2000 | Persson | |
| 6,122,833 | A | 9/2000 | Lorocco | |
| 6,216,352 | B1 | 4/2001 | Lorocco | |
| 6,360,472 | B1 | 3/2002 | Lorocco | |
| 6,366,726 | B1 * | 4/2002 | Wach et al. | 385/115 |
| 6,421,946 | B1 | 7/2002 | Lorocco | |
| 6,640,842 | B1 | 11/2003 | Carlson | |
| 7,238,935 | B2 * | 7/2007 | Asada et al. | 250/234 |
| 7,616,986 | B2 * | 11/2009 | Seibel et al. | 600/476 |
| 7,627,976 | B1 * | 12/2009 | Olson | 42/145 |
| 2002/0083602 | A1 * | 7/2002 | Slates | 33/265 |
| 2002/0166278 | A1 * | 11/2002 | Carlson | 42/132 |
| 2007/0107292 | A1 * | 5/2007 | Bar-Yona et al. | 42/144 |

* cited by examiner

*Primary Examiner* — Charlie Peng
*Assistant Examiner* — Peter Radkowski

(57) ABSTRACT

A fiber optic sight for a gun is disclosed that allows for increased illumination to the shooter's eyes by the use of an angled cut at the forward end of the fiber optic rod. The angled cut is positioned on the underside of the rod, and the fiber optic rod is exposed to the ambient light through the exterior surface of the rod onto the angled cut. The angled cut may be polished or be provided with a reflective surface that may be applied to, bonded to or positioned adjacent to the angled cut. The ambient light is directed along the major axis of the fiber optic rod towards the shooter's eyes. A reflector may also be positioned against the angled cut to enhance the reflectivity down the major axis of the fiber optic rod. The illumination may be further increased through the positioning of a light source alongside the fiber optic rod, with the light being directed onto the angled cut, and along the major axis of the fiber optic rod.

9 Claims, 6 Drawing Sheets

FIBER OPTIC SIGHT FOR FIREARMS

BACKGROUND OF THE INVENTION

1. Field of the Invention

This application relates broadly to a fiber optic sight for firearms. More particularly, it concerns an improved form of a fiber optic sight for use with firearms, including handguns and long arms.

2. Description of the Prior Art

There are many fiber optic sights available currently but there are a number of problems with such sights. Generally the sights offer less illumination to the shooter's eyes than is possible for a number of reasons. One of these is that the fiber optic rod used in the sights is positioned so that the front end of the fiber optic rod is not exposed to the direction of aim. This is to ensure that the shooter's position is not exposed or given away to a target. The sight uses illumination by ambient light being exposed to the outside surface of the fiber optic rod which causes the dyes with the rod to fluoresce and hence to direct light towards the shooter's eyes, but the need to ensure minimal exposure of the forward end of the fiber optic rod has over-ridden the potential to provide increased illumination to the shooter. Another reason is that the thermoplastics used with such fiber optic sights provide a poor absorption percentage of the light that is exposed to the sides of the fiber optic rod, thus decreasing the amount of light available for illumination. A number of different approaches have been used to provide increased illumination to the shooter's eyes and these include U.S. Pat. No. 6,640,842 (Carlson) and U.S. Patent Application 2007/0107292 (Bar-Yona et al). Carlson discloses the use of an artificial light source in combination with a fiber optic rod with an angled cut at its end. He applied the light from the artificial light source onto the angled surface of the fiber optic rod from below the rod. Furthermore, he prevented ambient light from contacting the outer surface of the rod above the angled surface and covered the angled surface so that very little or no ambient light reached the angled portion of the fiber optic rod. Bar-Yona et al discloses a fiber optic rod that is positioned at the front of the sight whereby ambient light is exposed to the rod through the exterior surface of the rod. An artificial light source in the form of a tritium insert is positioned directly in front of the fiber optic rod and the light from the source is directed down the rod towards the shooter's eyes. There are also many patents disclosing the use of fiber optic rods whereby ambient light is exposed or directed onto the outer surface of the rod, such as U.S. Pat. Nos. 5,638,604, 5,836,100, 5,956,854, 6,085,427, 6,122,833, 6,216,352, 6,360,472, and 6,421,946. However, a common feature of many of these patents is that the fiber optic rod is quite long. What is needed is a fiber optic sight that provides increased illumination to the shooter's eyes without exposing the end of the rod to the target. The fiber optic sight should use rods that are shorter in comparison to the prior art and ideally would fit within the original sight envelope. The fiber optic sight also should be able to be used with artificial light sources if required.

The present invention solves this issue by providing a fiber optic sight that provides for increased illumination with or without the use of an artificial light source. This is achieved by using a fiber optic rod that is angled at its forward end which allows ambient light from the exterior of the rod opposite the angled cut to reflect off the angled cut toward the shooters eyes.

OBJECTS

A principal object of the invention is to provide the shooter with a sighting system that results in increased illumination being directed towards the shooter's eyes. The sight achieves this through the use of an angled cut at the forward end of the fiber optic rod. The angled surface is positioned in a holder which secures the rod with the angled surface on the bottom of the rod and exposes the top portion of the rod to external ambient light. The angled cut can be polished and acts as a mirror surface that effectively redirects the light striking the exposed surface of the rod, which travels thru the rod then reflects off the polished angled surface back along the long axis of the fiber rod toward the shooters eyes. Additionally, a reflective coating or mirrored material can be applied directly to, mated or bonded to the polished angled surface to improve the reflectivity of the polished angled surface and further enhance the redirection of light striking the exposed portion of the fiber rod back along the long axis of the fiber toward the shooters eyes. The angled surface can be hidden from view forward of the sight by positioning the rod below the top surface of the holder. Adding a reflective coating or mirrored material to the angled surface also blocks any light from being reflected forward of the angled surface.

A further object is to provide a sighting system using fiber optic rods that may also be used with an artificial light source to further enhance the illumination available to the shooter. The artificial light source is directed against the outside diameter of the rod where it can also reflect off the polished angled surface back toward the shooters eyes.

Other objects and further scope of applicability of the present invention will become apparent from the detailed descriptions given herein; it should be understood however, that the detailed descriptions, while an indication of preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of unique improvements to fiber optic sights comprising:

(a) a fiber optic sight that allows for increased illumination to the shooter's eyes by the use of an angled cut at the forward end of the fiber optic rod, the angled cut being placed on the underside of the rod, and whereby the fiber optic rod is exposed to the ambient light through the exterior surface of the rod onto the angled cut.

(b) a fiber optic sight that further increases the illumination to the shooter's eyes by polishing the angled cut and/or providing a reflective surface applied to, bonded to, or positioned adjacent to the angled cut.

(c) a fiber optic sight that allows for increased illumination but at the same time uses a much shorter length of fiber optic rod than previous sights.

(d) A fiber optic sight that utilizes an artificial light source that is positioned alongside the fiber optic rod, with the artificial light being directed onto the rod toward the angled surface.

(e) A fiber optic sight which still provides increased illumination to the shooters eyes while protecting the fiber rod from shock and impact by mounting it in a holder which only exposes the fiber rod to light from above the top of the rod.

The first unique improvement is the use of an angled cut at the end of the fiber optic rod with the angled cut being placed on the underside of the rod when mounted into a sight base. The angled surface acts as a mirror which redirects light which strikes the external surface of the rod, travels thru the rod, strikes the angled surface and is then reflected back along the long axis of the rod toward the shooters eyes. This dramatically increases the amount of light directed towards the shooter's eyes but at the same time prevents light going forward, towards the target, by allowing the blocking of the end of the rod from the light.

A second unique improvement is achieved by the use of polishing the angled cut and/or forming a reflective surface on or placing a reflective surface against the angled cut. Polishing the angled surface alone enhances the reflectivity of the surface and enhances the amount of illumination directed toward the shooters eyes. The polished angled surface can also be mated to a reflective surface which further enhances the amount of illumination to the shooter's eyes. Bonding a reflective surface to the polished angled surface with an optically clear bonding agent provides nearly equal reflectivity to forming a reflective surface directly onto the polished angled surface.

A third unique improvement is the resulting decrease in length of the fiber optic rod because of the increased illumination. Until now, the fiber optic rod has been rather long and required a lot of its exterior surface to be exposed to light in order to provide sufficient illumination directed toward the shooters eyes. The disclosed invention has resulted in quite short lengths of fiber optic rod being used.

A fourth unique improvement is the ability to adequately protect the fiber optic rod from damage due to external shock by allowing the short optical fiber to be set into a pocket within the sight which provides protection for the fiber. Even with the relatively small amount of surface being exposed to illumination from ambient light, the amount of light directed toward the shooters eyes is still increased.

The final unique improvement is the capability to use an artificial light source in conjunction with the fiber optic sight. By correct positioning of the artificial light source, the light may be directed onto the fiber optic rod where it can reflect off the angled surface. The improved efficiency of the angled surface to redirect light toward the shooters eyes allows the artificial light source to be of lower power yet still provide sufficient illumination capabilities of the fiber optic sight.

BRIEF DESCRIPTION OF THE DRAWINGS

A more complete understanding of the invention can be obtained by reference to the accompanying drawings wherein.

DESCRIPTION OF PREFERRED EMBODIMENTS

Figure 1:
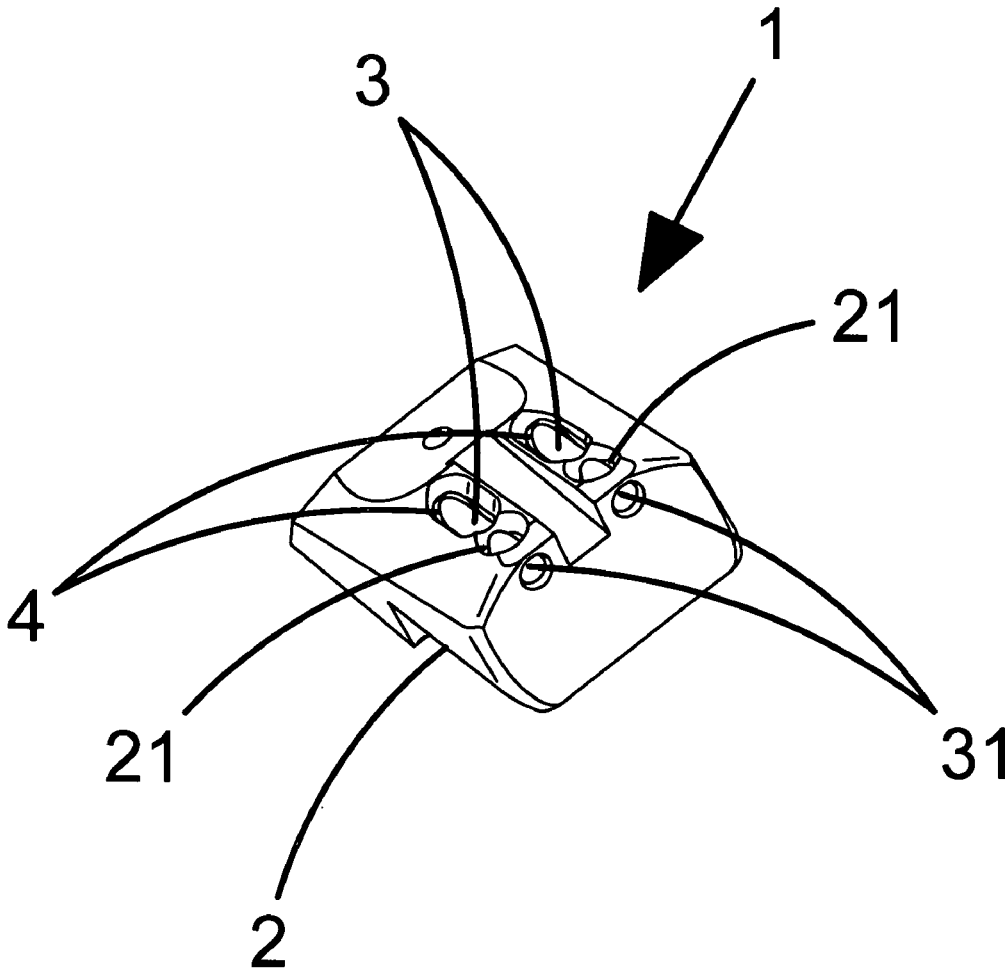
FIG. 1 is an isometric view of a typical fiber optic rear sight assembly.

Referring in detail to FIG. 1 of the drawings, the rear sight assembly 1 consists of a sight base 2 machined to accept fiber optic rods 3 and reflectors 4. The rear apertures 31 of fiber optic rods 3 are open to the rear of the sight so they are visible by to the shooter. Fiber optic rods 3 can be bonded to reflectors 4 with an optically clear bonding agent (not shown). Fiber optic rods 3 are secured to the sight base 2 by applying an optically clear bonding agent at cavities 21.

Figure 2:
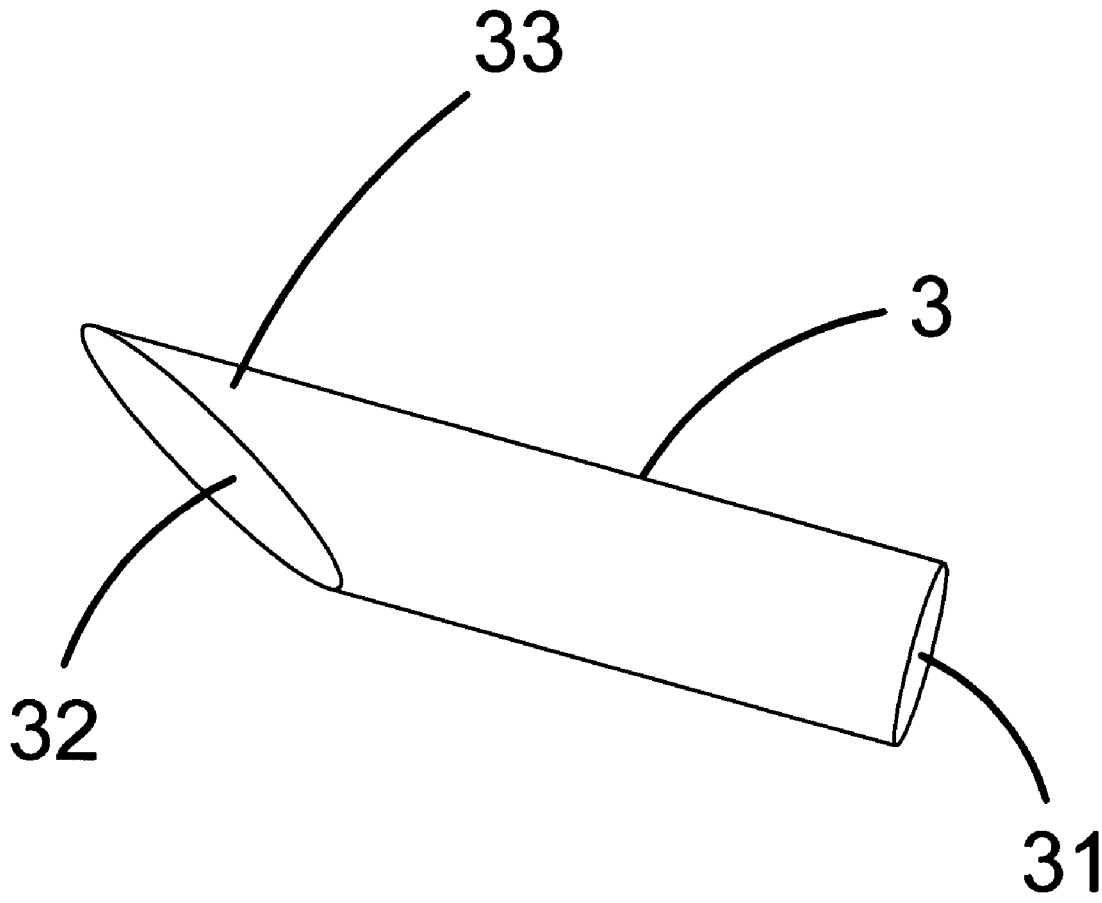
FIG. 2 is an isometric view of a typical fiber optic rod.

Referring in detail to FIG. 2 of the drawings, the fiber optic rod 3 has an aperture 31 at the proximal end which is positioned to emit light toward the eyes of the shooter (not shown). The tapered surface 32 is located at the distal end of fiber optic rod 3. It provides a surface from which light entering thru the outside surface 33 at the distal end of fiber optic rod 3 can be reflected down the major axis of the fiber optic rod 3 toward aperture 31.

Figure 3:
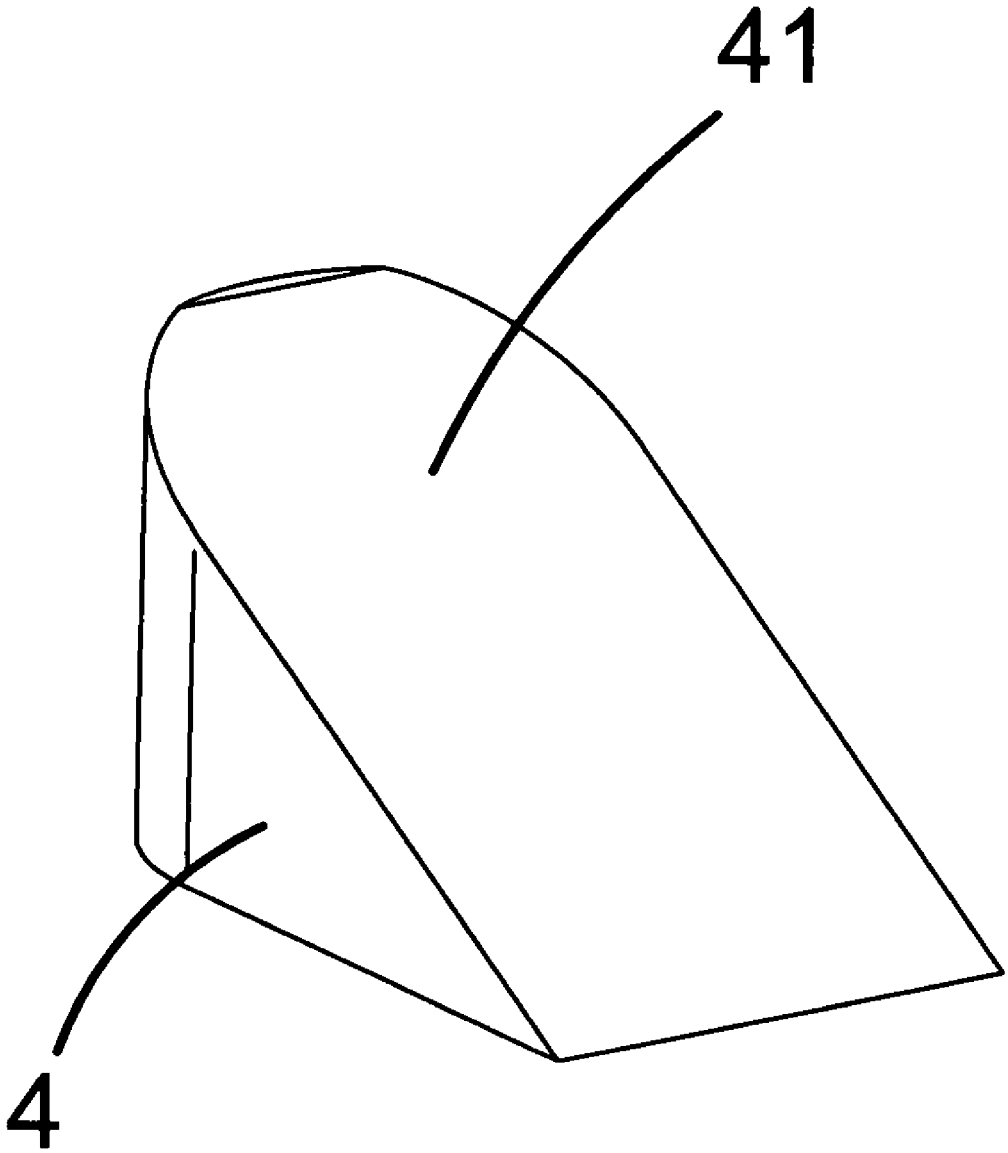
FIG. 3 is an isometric view of one type of reflector.

Referring in detail to FIG. 3 of the drawings, reflector 4 has a tapered surface 41 which is made highly reflective by one of any number of different processes.

Figure 4:
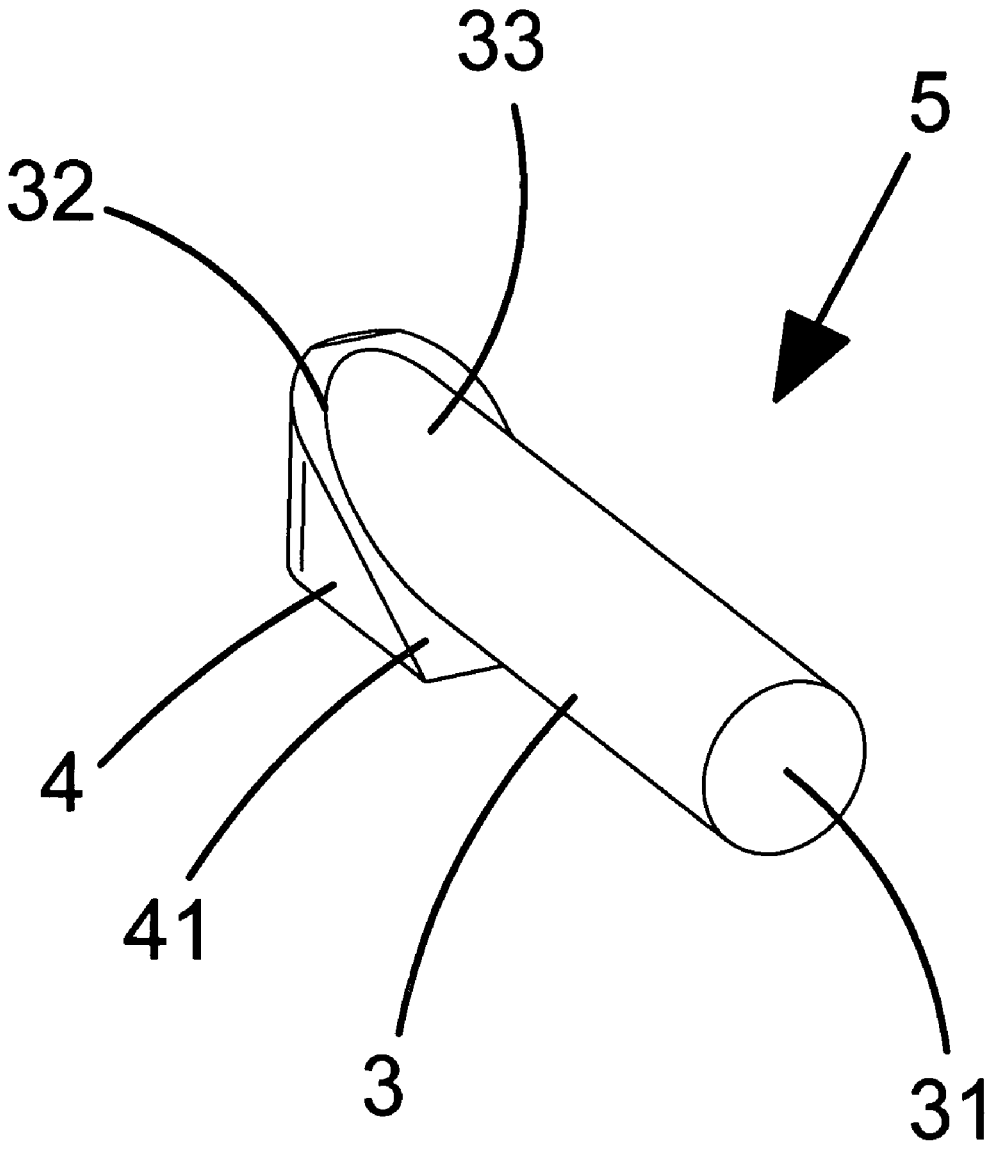
FIG. 4 is an isometric view of the sub-assembly comprising the fiber optic rod and the reflector.

Referring in detail to FIG. 4 of the drawings, subassembly 5 is comprised of fiber optic rod 3 and reflector 4. Tapered surface 41 on reflector 4 and tapered surface 32 on fiber optic rod 3 must meet surface to surface in order to optically perform the function of increasing the percentage of light entering outside surface 33 being reflected toward aperture 31. An optically clear bonding agent (not shown) can be applied at the joint between the reflecting surface 41 and tapered surface 32 to prevent intrusion of dirt or debris into the joint that would impair the efficiency of the reflective surface.

Figure 5:
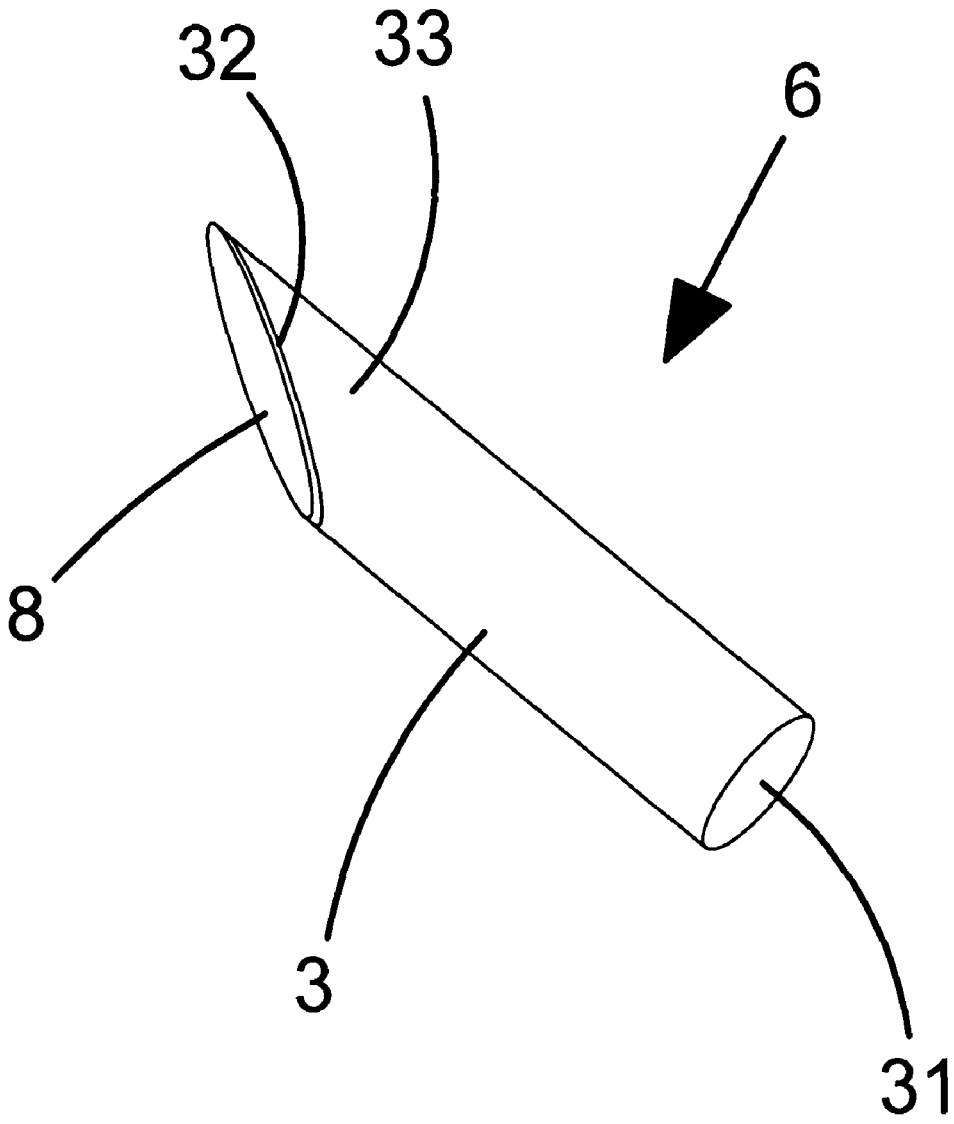
FIG. 5 is an isometric view of an alternate method of applying a reflector to a fiber optic rod.

Referring in detail to FIG. 5 of the drawings, in an alternate assembly 6, fiber optic rod 3 has a thin reflective coating 8 applied directly to, mated to, or mated and bonded to tapered surface 32. The reflective side of thin reflective coating 8 is located directly adjacent tapered surface 32. In this case the thin reflective coating 8 replaces the reflector 4 shown in FIG. 3 and FIG. 4. The thin reflective coating 8 acts to further assist in reflecting ambient light striking outside surface 33 of fiber optic rod 3 back toward aperture 31 and thence toward the shooters eyes. The thin reflective coating 8 can be a directly applied deposition of aluminum or other reflective material unto tapered surface 32 or can be a reflective material such as aluminum foil that can be applied or bonded to tapered surface 32.

The rear sight assembly 1 uses two fiber optic rods 3 mounted in the sight base 2. The distal ends of the rods have tapered surfaces 32 and these tapered surfaces abut two reflectors 4 while the proximal ends of the rods terminate in rear apertures 31. The fiber optic rods 3 are exposed to the ambient light through the outside surfaces 33 of the optic rod via the cavities 21 and the ambient light travels through the rods. It is reflected down the major axis of fiber optic rods 3 by the polished tapered surfaces 32 of the fiber optic rods and the reflective surfaces 41 of the reflectors 4. No light is directed away from the shooter towards a target due to the positioning of the fiber optic rods 3 in the sight base 2 and the reflector 4. The forward travel of light is blocked by sight base 2 and reflector 4. The angled surface is hidden from view by the positioning of the fiber optic rod below the upper surface of the sight base. This minimizes the potential for the target to become aware of the shooter due to an increase in light as could be the case if tapered surface 32 of the fiber optic rods were exposed to the target.

In an alternate embodiment, the reflector 4 is replaced with a reflective coating 8 that is applied directly to the tapered surface 32. The reflective coating replaces the reflector 4 that is used with the embodiment shown in FIGS. 1 to 4 and performs the same function as the reflector 4. Ambient light strikes the outside surface 33 of the fiber optic rod 3 and reflects the light back down the major axis of fiber optic rod 3 towards the aperture 31 and towards the shooter's eyes.

In another embodiment, to enhance the illumination available to the shooter, the sight may utilize an artificial light source. The artificial light source may be an LED (Light Emitting Diode), a radio-luminescent insert such as tritium, a chemo-fluorescent material or a phosphorescent material. To minimize the potential for light from the artificial light source to leak away from the shooter, the artificial light source is positioned so it directs its light onto the fiber optic rod 3 so that the light is directed toward the tapered cut 32. The reflected light from the tapered cut 32 would result in the artificial light being directed down the major axis of the fiber optic rod towards the shooter's eyes. The additional light available to the shooter will enhance the potential for the shooter to accurately hit the target in low light situations.

Figure 6:
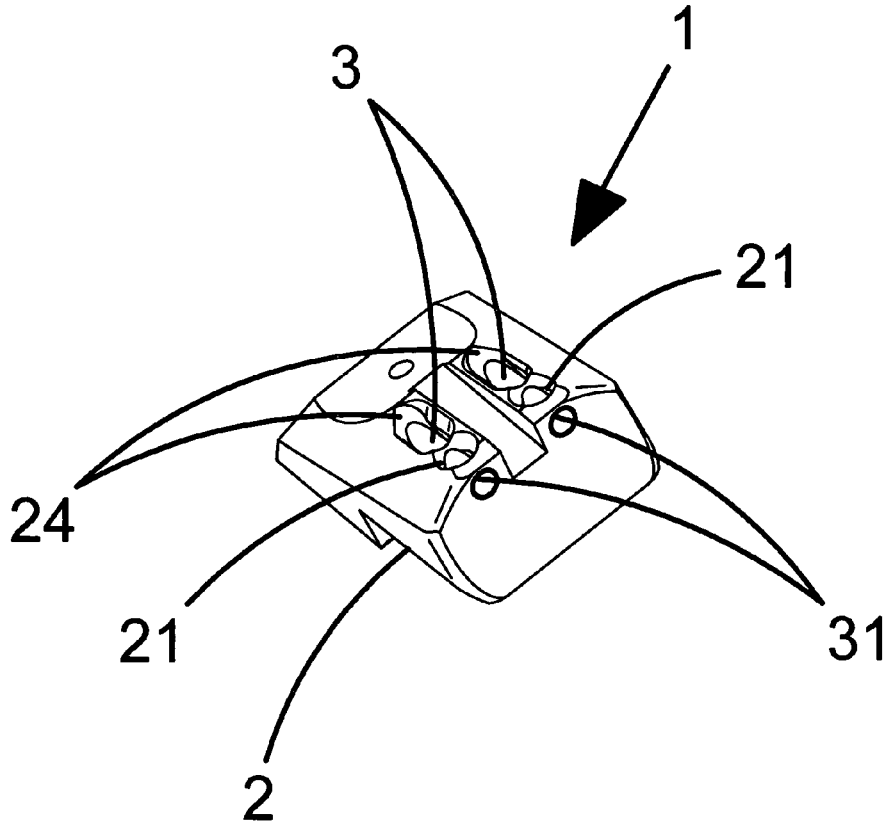
FIG. 6 is an isometric view of an alternate fiber optic rear sight assembly.

Referring in detail to FIG. 6 of the drawings, in alternate rear sight assembly 1, sight base 2 may be provided with an angled surface 24 that is machined or cast integral with sight base 2. Angled surface 24 is machined or cast into sight base 2 and is polished or coated with a reflective material such as chromium. The rear apertures 31 of fiber optic rods 3 are open to the rear of the sight so they are visible to the shooter. Angled surface 24 replaces reflector 4 as described in FIGS. 1 to 4 but achieves the same functions as the reflector 4. Angled surface 24 is positioned in the sight base 2 so that it abuts the fiber optic rod 3 when the fiber optic rod 3 is positioned within the sight base 2 as has been previously disclosed with other embodiments. The fiber optic rod may be positioned against the angled surface in the sight base 2 or it maybe bonded as has been previously disclosed with other embodiments.

The invention is disclosed with respect to a rear sight, but it should be understood that a front sight for a firearm may also use the disclosed invention. In the case of a typical front sight, only one fiber optic rod is used and positioned in a sight base with a reflector, two cavities and one aperture positioned at the proximal end of the front sight. The combination of a front and rear sight using the reflective surface fiber optic rods greatly increases and enhances the light available to the shooter's eyes. The use of the reflective surface on the fiber optic rods results in quite short lengths of fiber optic rod being used for the sights compared to prior art fiber optic sights.

While the invention has been shown and described with reference to a certain specific preferred embodiment, modification may now suggest itself to those skilled in the art. Such modifications and various changes in form and detail may be made herein without departing from the spirit and scope of the invention. Accordingly, it is understood that the invention will be limited only by the appended claims.

The invention claimed is:

1. A fiber optic sighting device comprising:

(a) a sight base, and (b) a fiber optic rod mounted in said sight base and having a proximal end and a distal end, wherein said distal end is cut at an angle to the longitudinal axis of said fiber optic rod, wherein said angled cut is positioned on the underside of the rod, and wherein said fiber optic rod is exposed to the visible ambient light, wherein said visible ambient light is directed through said fiber optic rod onto said angled cut; and whereby said visible ambient light is reflected along the major axis of said fiber optic rod and emitted from said proximal end of said fiber optic rod.

2. A fiber optic sighting device comprising:

(a) a sight base, (b) a fiber optic rod mounted in said sight base and having a proximal end and a distal end, wherein said distal end is cut at an angle to the longitudinal axis of said fiber optic rod, wherein said angled cut is positioned on the underside of the rod, and (c) a reflector mounted in said sight base and having a proximal end and a distal end, wherein said proximal end is cut at an angle to the longitudinal axis of the reflector, wherein said proximal end of the reflector is positioned against said angled cut on said fiber optic rod, wherein said fiber optic rod is exposed to the visible ambient light, wherein said visible ambient light is directed through said fiber optic rod onto said angled cut and said reflector, and whereby said visible ambient light is reflected along the major axis of said fiber optic rod and emitted from said proximal end of said fiber optic rod.

3. A fiber optic sighting device comprising:

(b) a sight base, (c) a fiber optic rod mounted in said sight base and having a proximal end and a distal end, wherein said distal end is cut at an angle to the longitudinal axis of said fiber optic rod, wherein said angled cut is positioned on the underside of the rod, wherein said fiber optic rod is exposed to the visible ambient light, wherein said visible ambient light is directed through said fiber optic rod onto said angled cut; whereby said visible ambient light is reflected back along the major axis of said fiber optic rod and emitted from said proximal end of said fiber optic rod; and (d) a light source, wherein said light source is positioned to direct its light onto the angled surface of said fiber optic rod whereupon said light is reflected along the major axis of said fiber optic rod and emitted from said proximal end of said fiber optic rod.

4. The fiber optic sighting device according to claim 3, wherein said light source emits light in the absence of visible ambient light.

5. The fiber optic sighting device according to claim 3, wherein said light source may be either a light emitting diode, or a radio-luminescent light source, or a chemo-fluorescent light source, or a long lived phosphorescent light source.

6. A fiber optic sighting device comprising:

(a) a sight base with integral angled reflective surface; and (b) a fiber optic rod mounted in said sight base and having a proximal end and a distal end, wherein said distal end is cut at an angle to the longitudinal axis of said fiber optic rod, wherein said angled cut is positioned on the underside of the rod, and wherein said 3 fiber optic rod is exposed to the visible ambient light, and wherein said visible ambient light is directed through said fiber optic rod onto said angled cut and said reflective surface, and whereby said visible ambient light reflected along the major axis of said fiber optic rod and emitted from said proximal end of said fiber optic rod.

7. A fiber optic sighting device comprising:

(a) a sight base with integral angled reflective surface;

(b) a fiber optic rod mounted in said sight base and having a proximal end and a distal end, wherein said distal end is cut at an angle to the longitudinal axis of said fiber optic rod, wherein said angled cut is positioned on the underside of the rod, and wherein said fiber optic rod is exposed to the visible ambient light, and wherein said visible ambient light is directed through said fiber optic rod onto said angled cut and said reflective surface, and whereby said visible ambient light reflected along the major axis of said fiber optic rod and emitted from said proximal end of said fiber optic rod; and (c) a light source, wherein said light source is positioned to direct its light onto the angled cut, and whereby said light emitted from said light source is reflected along the major axis of said fiber optic rod and emitted from said proximal end of said fiber optic.

8. The fiber optic sighting device according to claim 7, wherein said light source emits light in the absence of visible ambient light.

9. The fiber optic sighting device according to claim 7 wherein said light source may be either a light emitting diode, or a radio-luminescent light source, or a chemo-fluorescent light source, or a long lived phosphorescent light source.

* * * * *